US006768786B2

(12) United States Patent
Beyerlein et al.

(10) Patent No.: US 6,768,786 B2
(45) Date of Patent: Jul. 27, 2004

(54) CIRCUIT ARRANGEMENT AND METHOD FOR GENERATING AN X-RAY TUBE VOLTAGE

(75) Inventors: Walter Beyerlein, Bubenreuth (DE); Werner Kühnel, Uttenreuth (DE); Markus Hemmerlein, Neunkirchen/Br (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/601,142

(22) Filed: Jun. 20, 2003

(65) Prior Publication Data

US 2004/0017893 A1 Jan. 29, 2004

(30) Foreign Application Priority Data

Jun. 25, 2002 (DE) ..... 102 28 336

(51) Int. Cl.[7] ..... H05G 1/56
(52) U.S. Cl. ..... 378/114; 378/109; 378/111
(58) Field of Search ..... 378/109, 110, 378/111, 112, 114, 115, 119

(56) References Cited

U.S. PATENT DOCUMENTS 4,266,134 A * 5/1981 Franke et al. ..... 378/105
4,450,577 A * 5/1984 Sato et al. ..... 378/109
4,680,693 A * 7/1987 Carron ..... 363/98
4,809,310 A * 2/1989 Salesses et al. ..... 378/109

FOREIGN PATENT DOCUMENTS

DE 29 43 816 C2 6/1988

* cited by examiner

*Primary Examiner*—Craig E. Church
*Assistant Examiner*—Irakli Kiknadze
(74) *Attorney, Agent, or Firm*—Brinks Hofer Gilson & Lione

(57) ABSTRACT

A circuit arrangement for generating an X-ray tube voltage is described, wherein a switching device, connected downstream of a voltage controller ($G_{su}$) and a oscillating current controller ($G_{ri}$), operable to compare a first controlling variable value ($Y_{u(t)}$) and a second controlling variable value ($Y_{z(t)}$) and is operable to send the lesser of the first and second controlling variable values ($Y_{u(t)}$ and $Y_{z(t)}$ onward as a resultant controlling variable value (Y(t)) to the inverse rectifier circuit ($G_{si}$).

22 Claims, 3 Drawing Sheets

CIRCUIT ARRANGEMENT AND METHOD FOR GENERATING AN X-RAY TUBE VOLTAGE

Figure 1A:
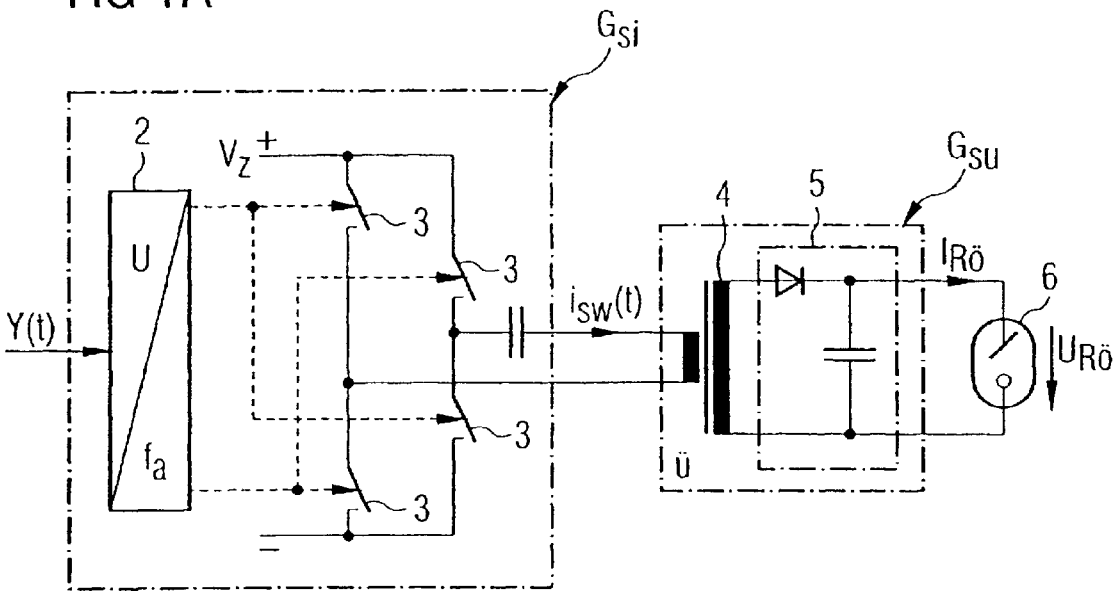

The invention relates to a circuit arrangement for generating an x-ray tube voltage, having an inverse rectifier circuit for generating a high-frequency alternating voltage, having a high-voltage generator for converting the high-frequency alternating voltage into a high voltage for the x-ray tube, and having a voltage controller, which on the basis of a deviation of an actual x-ray tube voltage from a set-point x-ray tube voltage generates a first controlling variable value for a controlling variable for the inverse rectifier circuit, for achieving an adaptation of the actual x-ray tube voltage to the set-point x-ray tube voltage. One such circuit arrangement is known from German Patent DE 29 43 816 C2.

The invention also relates to an x-ray generator having such a circuit arrangement, an x-ray system having such an x-ray generator, and a corresponding method for generating an x-ray tube voltage.

To generate an x-ray tube voltage, modern x-ray generators often have circuit arrangements of the typed defined at the outset. Since a line frequency is first rectified and then converted back into a high-frequency alternating voltage that is finally transformed to a desired voltage, such generators are also known as high-frequency generators. The voltage controller serves to regulate the high voltage at the x-ray tube as optimally as possible in terms of time to a diagnostically required value with a requisite precision.

Compared to conventional generators, in which the high voltage is first transformed using the line frequency present, then rectified, and finally delivered to the x-ray tube, such a circuit arrangement has the advantage that in principle, it can be made virtually independent of changes to a line voltage and to a tube current by means of a relatively fast closed-loop current circuit. The tube voltage is therefore highly replicable and can be kept constant. Compared to so-called direct voltage generators, in which a high voltage, transformed at line frequency and rectified, is finely regulated with the aid of triodes, high-frequency generators have the advantage of a relatively small structural volume and lower production costs. These advantages are the reason for the preferred use of such circuit arrangements in modern x-ray generators.

In conventional circuit arrangements of the type defined at the outset problems arise from the fact that parameters of a controlled system including an inverse rectifier and the high-voltage circuit, depending on the selected operating point of the x-ray tube, cover a wide range of values, and that in particular the inverse rectifier's resonance characteristic is a highly nonlinear member of the closed-loop control circuit. Moreover, if damage to the power semiconductor is to be avoided, an oscillating current of the inverse rectifier must not exceed a predetermined maximum value. In a conventional single-step x-ray tube voltage closed-loop control circuit, a control speed of the circuit must therefore be set to be at least slow enough that the oscillating circuit current, even during running up to speed or when being turned on, does not exceed the maximum allowable value. As a result, a small-signal behavior of the closed-loop control circuit is also slowed down, resulting in a slower elimination of interference variables than would intrinsically be possible. Moreover, with this kind of a single-step control, the oscillating current is limited only indirectly. Therefore if the inverse rectifier is redimensioned, the control parameters of the controller must be adapted to suit the oscillating current. A simple voltage controller can thus meet the demands, even if only to an unsatisfactory extent.

It is therefore the object to create an alternative to the known prior art that permits high-speed control without exceeding the maximum allowable oscillating current.

This object is attained by a circuit arrangement as defined by claim 1 and by a method as defined by claim 9.

To that end, the circuit arrangement additionally has a measurement circuit for measuring an oscillating current, applied to one output of the inverse rectifier circuit, of the high-frequency alternating voltage. By means of an oscillating current controller, a second controlling variable value for the aforementioned controlling variable of the inverse rectifier circuit is then generated on the basis of a deviation of an ascertained actual oscillating current value from a predetermined maximum oscillating current value. The voltage controller and the oscillating current controller are then coupled in series to a switching device, which compares a first controlling variable value and a second controlling variable value and forwards only the lesser of the two controlling variable values, as the resultant controlling variable value, to the inverse rectifier circuit.

A second controlling variable value is ascertained separately by means of an oscillating current controller on the basis of the deviations of an actual oscillating current value from a predetermined maximum oscillating current value and compared with the first controlling variable value of the voltage controller, and only the lesser of the two controlling variable values is delivered to the inverse rectifier circuit. It is attained that in a normal situation, very fast control by the voltage controller is accomplished; and only in extreme cases, if a critical range for the oscillating current is attained, is the voltage controller relieved by the oscillating current controller. In other words, in this "relief control", as long as the voltage controller is functioning "normally" and provides only an oscillating current that is less than the maximum allowable oscillating current, the controlling variable of the voltage controller will be sent on to the controlled system. Only if the maximum allowable oscillating current is reached or exceeded, which will be the case for instance during running up to speed as a rule, does the oscillating current controller come into play and limit the oscillating current to its maximum allowable value.

The dependent claims contain various especially advantageous features and refinements of the invention.

Preferably, for at least one of the two controllers and especially preferably for both controllers, a PI controller (proportional-integral controller) is used. An integral portion of the applicable controller has an object of forcing a steady-state control error, that is a control error in a steady state, to zero. Thus a persistent control deviation is reliably avoided. The controllers preferably then comprise series-connected proportional parts and integral parts. The advantage over a parallel PI controller structure is that now the controller parameters pertaining to an amplification and an adjustment or a readjustment time can be set separately from one another. Instead of a PI controller, a PID controller can also be used.

In an especially preferred exemplary embodiment, an output of the switching device is connected to one input of the voltage controller and/or of the oscillating current controller, for feeding back the resultant controlling variable value. The voltage controller and/or the oscillating current controller are embodied such that they forward the resultant controlling variable value, if the controlling variable value generated by the applicable controller is not forwarded as the resultant controlling variable value.

To that end, the applicable controller compares the resultant controlling variable with its own controlling variable value that is internally also fed back. As a result of this variant, additional transient events caused by abrupt changes or surges upon switchover between the two controllers are reliably prevented.

Preferably, the switching device is embodied such that it sends at least a predetermined minimum controlling variable value as the resultant controlling variable value onward to the inverse rectifier circuit. Moreover, preferably at most, a predetermined maximum controlling variable value is sent onward, as the resultant controlling variable value, to the inverse rectifier circuit. Hence, the result controlling variable is actively limited to a range between the minimum value and the maximum value.

Since the controller parameters, being the controller amplification and the readjustment time, are as a rule dependent on the operating point, the voltage controller and/or the oscillating current controller preferably can each vary at least one parameter (i.e., controller parameter) of the applicable controller as a function of a set x-ray tube voltage and/or as a function of a set x-ray tube current. That parameter is then fed to corresponding inputs of the respective controller, and as a result the parameters of the applicable controllers are suitably set internally.

A circuit arrangement according to the invention can in principle be used to generate an x-ray tube voltage in any conventional x-ray generator, regardless of how the x-ray generator is constructed in terms of its further components, such as the various measuring instruments or the supply of heating current. The invention can also be employed largely independently of the concrete embodiment of the inverse rectifier circuit and of the high-voltage generator.

Figure 1B:
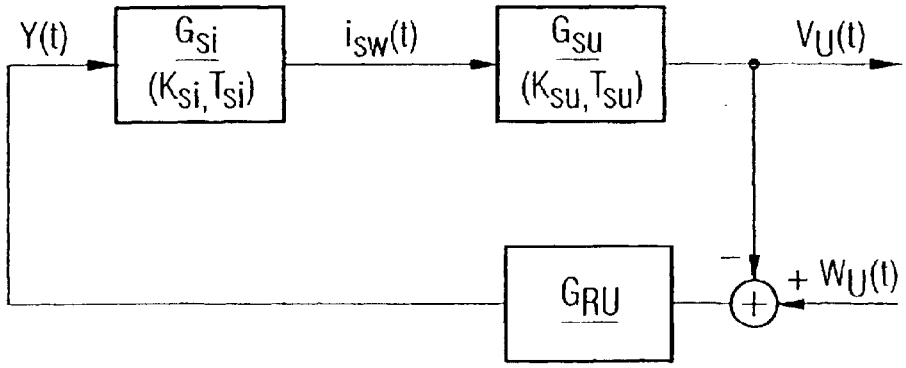

The invention will be described in further details below in terms of exemplary embodiments in conjunction with the drawings. From the described examples and drawings, still other advantages, characteristics and details of the invention will become apparent. Shown are:

FIG. 1*a*, a circuit diagram of a prior art circuit arrangement embodiment, with an inverse rectifier circuit and a high-voltage generator for generating a high voltage for an x-ray tube;

FIG. 1*b*, a block diagram of an embodiment of a closed-loop control circuit for the prior art circuit arrangement shown in FIG. 1*a;*

Figure 2:
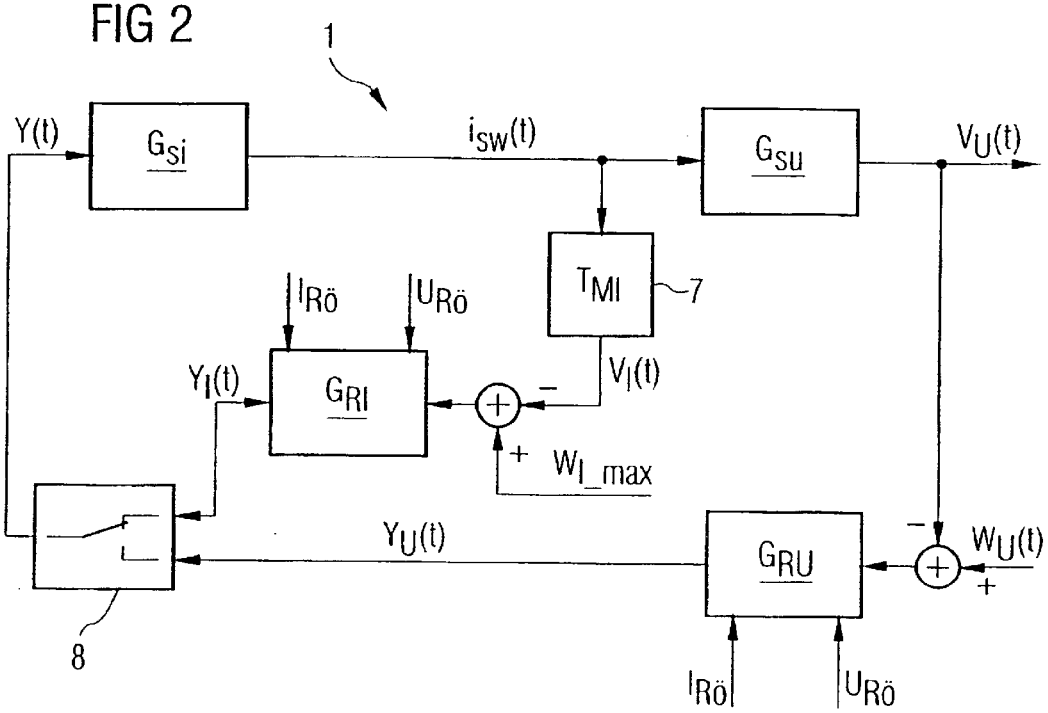
Figure 3:
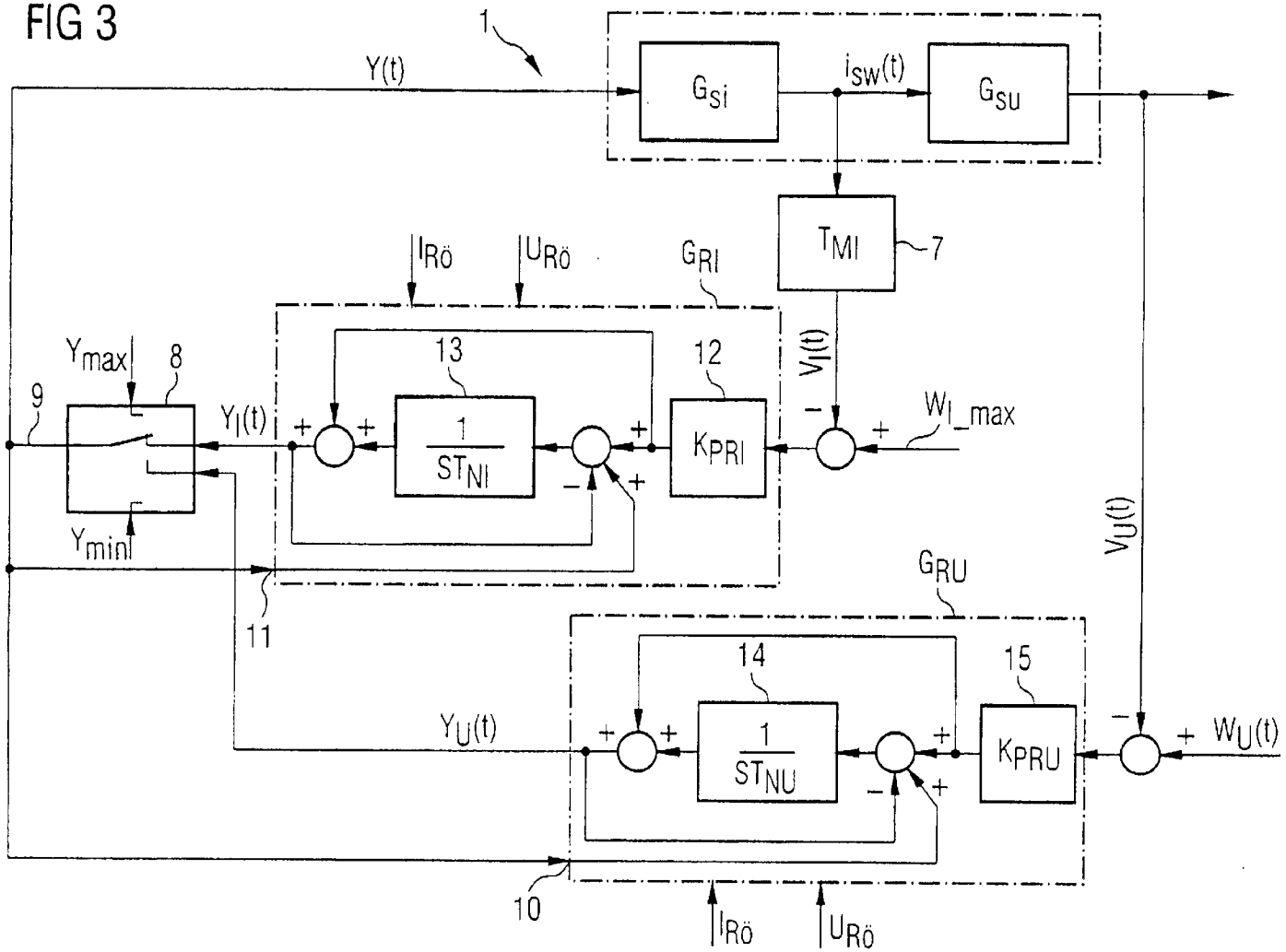

FIG. 2, a block diagram of an embodiment of the closed-loop control circuit in a circuit arrangement according to the invention; and FIG. 3, a more-detailed block diagram of an embodiment of the closed-loop control circuit of an especially advantageous variant of the circuit arrangement of the invention.

In FIG. 1*a*, typical components of an x-ray generator are shown; they represent the controlled system for the control of the x-ray tube voltage $U_{Rö}$. These typical components include first an oscillating current inverse rectifier $G_{si}$ coupled to a high-voltage generator $G_{su}$, which is in turn coupled to an x-ray tube 6.

The inverse rectifier circuit $G_{si}$ has a plurality of power semiconductors 3, which are connected accordingly such that an intermediate circuit direct voltage $V_z$ is converted into a high-frequency voltage. The inverse rectifier circuit $G_{si}$ furthermore has a voltage frequency converter 2, which converts a voltage value Y(t) into a triggering frequency $f_a$, with which the power semiconductors 3 of the inverse rectifier $G_{si}$ are triggered. The input voltage thus forms the controlling variable Y(t) of the controlled system.

The inverse rectifier circuit $G_{si}$ here is an oscillating circuit inverse rectifier (inverter). However, still other inverse rectifier circuits can be used, such as a square-wave inverse rectifier or arbitrary series-connected or multi-resonance inverse rectifiers.

The high-voltage generator $G_{su}$ comprises first a transformer 4 with a transmission factor ü and second, a rectifier and smoothing device 5 connected downstream of the transformer. The x-ray tube voltage $U_{Rö}$ present at the output of the rectifier circuit and smoothing device 5 is delivered to the x-ray tube 6.

FIG. 1*b* shows a block diagram of a closed-loop control circuit according to the prior art. The inverse rectifier circuit $G_{si}$ is represented here as a function block that includes a proportional transmission factor $K_{si}$ and a time constant $T_{si}$. In particular, the proportional transmission factor $K_{si}$, because of resonance phenomena in the inverse rectifier $G_{si}$, is highly nonlinear, or in other words depends on the operating point of the inverse rectifier $G_{si}$.

The high-voltage generator $G_{su}$ is also shown as a function block. It can be described by the proportional transmission factor $K_{su}$ and the time constant $T_{su}$; both of these variables are directly dependent on the x-ray tube voltage $U_{Rö}$ and the x-ray tube current $I_{Rö}$, or in other words, as a function of the operating point, both of these variables cover a wide range of values. The oscillating current of the inverse rectifier $G_{si}$ is represented by the symbol $i_{sw}(t)$ and supplies the primary winding of the high-voltage transformer 4 of the high-voltage generator $G_{su}$. To avoid damaging the power semiconductors 3 in the inverse rectifier circuit $G_{si}$, the oscillating current $i_{sw}(t)$ must not exceed a maximum value.

In the prior art, to regulate the output voltage of the high-voltage generator $G_{su}$, an actual voltage $V_U(t)$ applied there at a certain instant t is compared with a set-point value $W_U(t)$, which corresponds to the desired x-ray tube voltage $U_{Rö}$; that is, the difference is delivered to a voltage controller $G_{RU}$, which is once again shown here in the form of a function block.

This voltage controller $G_{RU}$ is conventionally a simple PI controller, which as a function of the deviation of the actual value $V_U(t)$ from the set-point value $W_U(t)$ generates the controlling variable Y(t), which is then fed to the input of the voltage frequency converter 2 of the inverse rectifier circuit $G_{si}$.

In this kind of conventional closed-loop control circuit shown in FIG. 1*b*, the control speed of the voltage controller $G_{RU}$ must be adjusted or set so slowly that the oscillating current $i_{sw}(t)$ does not exceed the maximum allowable value even during running up to speed. This means that a fast control is not possible with the voltage controller $G_{RU}$, and thus interference can also be eliminated only slowly. Upon a re-dimensioning of the inverse rectifier circuit $G_{si}$, the controller parameters of the voltage controller $G_{RU}$ must also be adapted accordingly, only an indirect limitation of the oscillating current $i_{sw}(t)$ is accomplished.

FIG. 2, in comparison to FIG. 1*b*, clearly shows the change according to the invention in the structure of the closed-loop control circuit. In this relief control, a switchover 8 is made according to the invention between two closed-loop control circuit structures of substantially parallel construction.

As in the prior art of FIG. 1*b*, here as well the x-ray tube voltage controller $G_{RU}$ suitably forms a controlling variable $Y_U(t)$ from the difference between the desired x-ray tube voltage, that is, the set-point voltage $W_U(t)$, and the factual x-ray tube voltage, that is, the actual x-ray tube voltage $V_U(t)$.

In addition, the oscillating current $i_{sw}(t)$ is measured by means of a smoothing member 7. This smoothing member 7 is described in terms of control technology by the additional time constant $T_{MI}$. The actual oscillating current value $V_I(t)$ thus ascertained is compared with a maximum allowable oscillating current value $W_{I_max}$ (or set-point value); that is, the difference between these values is formed and delivered to a further controller, which is the oscillating current controller $G_{RI}$, which likewise forms a controlling variable value $Y_I(t)$ for the controlling variable for the inverse rectifier circuit $G_{si}$.

Both the first controlling variable value $Y_U(t)$, which is formed by the voltage controller $G_{RU}$, and the second controlling variable value $Y_I(t)$, which is formed by the oscillating current controller $G_{RI}$, are delivered to a switching device 8. From between the two controlling variable values $Y_U(t)$ and $Y_I(t)$, this switching device 8 selects the controlling variable value $Y_U(t)$, or $Y_I(t)$ that at the current instant t is the lesser of the two, and sends the controlling variable value $Y_U(t)$, or $Y_I(t)$, as the resultant controlling variable value Y(t), onward to the inverse rectifier circuit $G_{si}$.

Here, both the controllers $G_{RI}$, $G_{RU}$ include a PI controller. A persistent control deviation is avoided by means of the integral component of the PI controller.

This relief control according to FIG. 2 has the advantage that in a "normal case", the voltage controller $G_{RU}$ is responsible for regulating the x-ray tube voltage. Only in those cases when the actual controlling variable value $Y_U(t)$ generated by the voltage controller $G_{RU}$ would cause the oscillating current $i_{sw}(t)$ to exceed an allowed maximum value is the actual controlling variable value $Y_I(t)$ generated by the oscillating current controller $G_{RI}$ less than the controlling variable value $Y_U(t)$ generated by the voltage controller $G_{RU}$. In those cases, the voltage controller $G_{RU}$ is therefore rendered quasi-inoperative, and only the oscillating current controller $G_{RI}$ is active. This has the advantage that the voltage controller $G_{RU}$ can be adjusted considerably faster than in a closed-loop control circuit according to the prior art, and interference variables can thus be eliminated correspondingly quickly. Nevertheless, the relief in extreme cases reliably prevents the oscillating current $i_{sw}(t)$ from exceeding the allowed maximum value.

Given the structure of the invention, in the normal case the x-ray tube voltage control itself is not slowed down by the measuring time constant $T_{MI}$ of the oscillating current $i_{sw}(t)$, since the smoothing member 7 is not located in the closed-loop control circuit for the x-ray tube voltage.

Since the parameters of the two partial controlled systems are each dependent on the operating point of the x-ray tube 6, the dimensioning of the two controllers $G_{RU}$, $G_{RI}$ can be facilitated substantially if their parameters, being the controller amplifications and the readjustment times, are controlled as a function of the operating point. To that end, as schematically shown in FIG. 2, the values for the set x-ray tube voltage $U_{Rö}$ and the set x-ray tube current $I_{Rö}$ are delivered to the two controllers $G_{RI}$, $G_{RU}$, respectively.

FIG. 3 shows a more-detailed structural view of the closed-loop control circuit of FIG. 2; here the closed-loop control circuits have additional, especially advantageous characteristics.

One additional characteristic is that the switching device 8 here has still further inputs, by way of which a maximum controlling variable value $Y_{max}$ and a minimum controlling variable value $Y_{min}$ are specified to the switching device 8. The switching device 8 is constructed such that at least the minimum controlling variable value $Y_{min}$ and at maximum the maximum controlling variable value $Y_{max}$ are output. In other words, a controlling variable range is dynamically specified, within which the controlling variable Y(t) sent onward at that time to the inverse rectifier circuit $G_{si}$ varies. The maximum controlling variable value $Y_{max}$ and the minimum controlling variable value $Y_{min}$ are as a rule set at the factory. To this extent, they can already be predetermined by means of the suitable design of the switching device 8 itself.

FIG. 3 also shows a further detailed structure of the voltage controller $G_{RU}$ and of the oscillating current controller $G_{RI}$. These are both PI controllers, with a proportional component 12, 15 and an integral component 13, 14 series-connected with it. In terms of control technology, the proportional components 12, 15 are each determined by transmission factors $K_{PRI}$ and $K_{PRU}$, respectively; and the integral components 13, 14 are determined by time constants $T_{NI}$ and $T_{NU}$, respectively.

This construction shown in FIG. 3, with series-connected proportional components 12, 15 and integral components 13, 14 has an advantage, over a parallel PI controller structure, in that the controller amplifications $K_{PRI}$, $K_{PRU}$ and the readjustment times $T_{NI}$, $T_{NU}$ can each be set separately from one another.

As a further characteristic in this exemplary embodiment, the resultant controlling variable value Y(t) is fed back by a connection of the output 9 of the switching device 8 to additional inputs 10, 11 of the voltage controller $G_{RU}$ and the oscillating current controller $G_{RI}$, respectively. Internally, the controlling variable value $Y_U(t)$ or $Y_I(t)$, generated by the respective controller $G_{RU}$ or $G_{RI}$ and is fed back to upstream of the integral component 13 or 14, and the difference between the fed-back, resultant controlling variable value Y(t) and each specific controlling variable value $Y_U(t)$, $Y_I(t)$ is formed.

This means that the two controllers $G_{RU}$, $G_{RI}$ each have limitation observers, which are coupled such that the integral component 13, 14 of whichever controller $G_{RU}$, $G_{RI}$ is inactive at the time is carried along with the integral component 13, 14 of the active controller—that is, the controller $G_{RU}$ or $G_{RI}$ whose controlling variable value $Y_U(t)$, $Y_I(t)$ just then forms the resultant controlling variable value Y(t). In this way, interference upon switchover between the controllers $G_{RU}$, $G_{RI}$ is avoided. Otherwise, there would be the risk that the controllers $G_{RU}$, $G_{RI}$ run up to a stop, which would cause the integral components 13, 14 to be overloaded. That in turn would worsen a transient response upon a switchover (known as a wind-up effect).

Once again, it will be pointed out that the circuit arrangements shown in the drawings are solely exemplary embodiments, and for one skilled in the art, many possible variations exist for achieving a circuit arrangement according to the invention. For instance, adaptive control of the voltage controller can be done, in such a way that the readjustment time is set as a function of the actual value of the tube voltage over the course of the tube voltage.

What is claimed is:

1. A circuit arrangement, for generating an x-ray tube voltage, comprising:

an inverse rectifier circuit ($G_{si}$) for generating a high-frequency alternating voltage, a high-voltage generator ($G_{su}$) for converting the high-frequency alternating voltage into a high voltage for the x-ray tube, a voltage controller ($G_{RU}$), which based on a deviation of an x-ray tube voltage ($V_U(t)$) from a set-point x-ray tube voltage ($W_{U(t)}$) generates a first controlling variable value ($Y_{U(t)}$) for the inverse rectifier circuit ($G_{si}$), a measurement circuit for measuring an oscillating current ($i_{sw(t)}$) applied to one output of the inverse rectifier circuit ($G_{si}$) of the high-frequency alternating voltage, an oscillating current controller ($G_{RI}$), which based on a deviation of an ascertained actual oscillating current value ($V_I(t)$) from a predetermined maximum oscillating current value ($W_{I-max}$) generates a second controlling variable value ($Y_{I(t)}$) for the inverse rectifier circuit ($G_{si}$), and wherein a switching device, connected downstream of the voltage controller ($G_{RU}$) and the oscillating current controller ($G_{RI}$), operable to compare the first controlling variable value ($Y_{U(t)}$) and the second controlling variable value ($Y_{I(t)}$) and is operable to send the lesser of the first and second controlling variable values ($Y_{U(t)}$ and $Y_{I(t)}$) onward as a resultant controlling variable value (Y(t)) to the inverse rectifier circuit ($G_{si}$).

2. The circuit arrangement as of claim 1, wherein at least one of the voltage controller ($G_{RU}$) and the oscillating current controller ($G_{RI}$) includes a PI controller.

3. The circuit arrangement as of claim 2, wherein one output of the switching device is connected to at least one of the voltage controller ($G_{RU}$) and of the oscillating current controller ($G_{RI}$); and that the voltage controller ($G_{RU}$) and the oscillating current controller ($G_{RI}$) are such the resultant controlling variable value (Y(t)) is carried along, if neither one of the controlling variable values ($Y_{U(t)}$) and ($Y_{I(t)}$) generated by their respective controllers is sent onward as the resultant controlling variable value (Y(t)).

4. The circuit arrangement as of claim 3, wherein the switching device is such that no controlling variable lower than a predetermined minimum controlling variable value ($Y_{min}$) is sent onward as the resultant controlling variable value (Y(t)) to the inverse rectifier circuit ($G_{si}$).

5. The circuit arrangement as of claim 4, wherein switching device is such that no controlling variable higher than a predetermined maximum controlling variable value ($Y_{min}$) is send onward as the resultant controlling variable value (Y(t)) to the inverse rectifier circuit ($G_{si}$).

6. An x-ray generator having a circuit arrangement of claim 5.

7. The circuit arrangement as of claim 1, wherein one output of the switching device is connected to at least one of the voltage controller ($G_{RU}$) and of the oscillating current controller ($G_{RI}$); and that the voltage controller ($G_{RU}$) and the oscillating current controller ($G_{RI}$) are such the resultant controlling variable value (Y(t)) is carried along, if neither one of the controlling variable values ($Y_{U(t)}$) and ($Y_{I(t)}$) generated by their respective controllers is sent onward as the resultant controlling variable value (Y(t)).

8. The circuit arrangement as of claim 1, wherein the switching device is such that no controlling variable lower than a predetermined minimum controlling variable value ($Y_{min}$) is sent onward as the resultant controlling variable value (Y(t)) to the inverse rectifier circuit ($G_{si}$).

9. The circuit arrangement as of claim 1, wherein switching device is such that no controlling variable higher than a predetermined maximum controlling variable value ($Y_{min}$) is send onward as the resultant controlling variable value (Y(t)) to the inverse rectifier circuit ($G_{si}$).

10. The circuit arrangement as of claim 1, wherein at least one of the voltage controller ($G_{RU}$) and the oscillating current controller ($G_{RI}$) can vary at least one parameter, the at least one parameter being a function of at least one of a set x-ray tube voltage ($U_{R\ddot{o}}$) and a set x-ray tube current ($I_{R\ddot{o}}$).

11. An x-ray generator having a circuit arrangement of claims 1.

12. An x-ray system having an x-ray generator of claim 11.

13. A method for generating an x-ray tube voltage where a high-frequency alternating voltage is generated via an inverse rectifier circuit ($G_{si}$), the high-frequency alternating voltage is converted into a high voltage for the x-ray tube v a high-voltage generator ($G_{su}$), and a first controlling variable value ($Y_{U(t)}$) is generated for the inverse rectifier circuit ($G_{si}$) via a voltage controller ($G_{RU}$) due to a deviation of an x-ray tube voltage ($V_U(t)$) from a set-point x-ray tube voltage ($W_{U(t)}$), the method comprising:

measuring an oscillating current ($i_{sw(t)}$) via a measurement circuit that is connected to one output of the inverse rectifier circuit ($G_{si}$) of the high-frequency alternating voltage, generating a second controlling variable value ($Y_{I(t)}$) for the inverse rectifier circuit ($G_{si}$) via an oscillating current controller ($G_{RI}$), due to a deviation of an ascertained actual oscillating current value ($V_I(t)$) from a predetermined maximum oscillating current value ($W_{I-max}$), comparing the first controlling variable value ($Y_{U(t)}$) and the second controlling variable value ($Y_{I(t)}$) via a switching device, the switching device being connected downstream of the voltage controller ($G_{RU}$) and the oscillating current controller ($G_{RI}$), and sending the lesser of the first and second controlling variable values ($Y_{U(t)}$ and $Y_{I(t)}$) onward as a resultant controlling variable value (Y(t)) to the inverse rectifier circuit ($G_{si}$).

14. The method as of claim 13, further comprising using a PI controller in at least one of the voltage controller ($G_{RU}$) and the oscillating current controller ($G_{RI}$).

15. The method as of claim 14, further comprising feeding back the resultant controlling variable value (Y(t)) as an input value to at least one of the voltage controller ($G_{RU}$) and to the oscillating current controller ($G_{RI}$), and carrying along the resultant controlling variable value (Y(t)), if neither one of the controlling variable values ($Y_{U(t)}$) and ($Y_{I(t)}$) generated by their respective controllers is sent onward as the resultant controlling variable value (Y(t)).

16. The method as of claim 14, further comprising sending onward as the resultant controlling variable value (Y(t)) to the inverse rectifier circuit ($G_{si}$), via the switching device, a controlling variable not lower than a predetermined minimum controlling variable value ($Y_{min}$).

17. The method as of claim 14, further comprising sending onward as the resultant controlling variable value (Y(t)) to the inverse rectifier circuit ($G_{si}$), via the switching device, a controlling variable not higher than a predetermined maximum controlling variable value ($Y_{max}$.

18. The method as of claim 14, further comprising varying at least one parameter within at least one of the voltage controller ($G_{RU}$) and the oscillating current controller ($G_{RI}$), the at least one parameter being a function of at least one of a set x-ray tube voltage ($U_{R\ddot{o}}$) or a set x-ray tube current ($I_{R\ddot{o}}$).

19. The method as of claim 13, further comprising feeding back the resultant controlling variable value (Y(t)) as an input value to at least one of the voltage controller ($G_{RU}$) and/or to the oscillating current controller ($G_{RI}$), and carrying along the resultant controlling variable value (Y(t)), if neither one of the controlling variable values ($Y_{U(t)}$) and ($Y_{I(t)}$) generated by their respective controllers is sent onward as the resultant controlling variable value (Y(t)).

20. The method as of claim 13, further comprising sending onward as the resultant controlling variable value (Y(t))

to the inverse rectifier circuit ($G_{si}$), via the switching device, a controlling variable not lower than a predetermined minimum controlling variable value ($Y_{min}$).

21. The method as of claim 13, further comprising sending onward as the resultant controlling variable value (Y(t)) to the inverse rectifier circuit ($G_{si}$), via the switching device, a controlling variable not higher than a predetermined maximum controlling variable value ($Y_{max}$.

22. The method as of claim 13, further comprising varying at least one parameter within at least one of the voltage controller ($G_{RU}$) and the oscillating current controller ($G_{RI}$), the at least one parameter being a function of at least one of a set x-ray tube voltage ($U_{Rö}$) and a set x-ray tube current ($I_{Rö}$).

* * * * *

UNITED STATES PATENT AND TRADEMARK OFFICE

CERTIFICATE OF CORRECTION

PATENT NO. : 6,768,786 B2
APPLICATION NO. : 10/601142
DATED : July 27, 2004
INVENTOR(S) : Walter Beyerlein et al.

It is certified that error appears in the above-identified patent and that said Letters Patent is hereby corrected as shown below:

On the Title Page

In column 2, line 7, under "ABSTRACT" immediately after "$Y_{z(t)}$" insert --)-- (close parenthesis).

In the Claims

Column 7, in claim 5, line 3, before "onward as the" delete "send" and substitute --sent-- in its place.

Column 7, in claim 9, line 4, before "onward as the" delete "send" and substitute --sent-- in its place.

Column 7, in claim 11, line 2, delete "claims 1" and substitute --claim 1-- in its place.

Column 8, in claim 13, line 4, after "for the x-ray tube" delete "v" and substitute --via-- in its place.

Column 8, in claim 17, line 5, after "controlling variable value" delete "($Y_{max}$·" and substitute --($Y_{max}$).-- in its place.

Column 9, in claim 21, line 5, after "controlling variable value" delete "($Y_{max}$·" and substitute --($Y_{max}$).-- in its place.

Signed and Sealed this

Thirteenth Day of November, 2007

JON W. DUDAS
*Director of the United States Patent and Trademark Office*